US009101184B2

(12) United States Patent
Wilson

(10) Patent No.: US 9,101,184 B2
(45) **Date of Patent: *Aug. 11, 2015**

(54) ELECTRONIC DEVICE CASING

(71) Applicant: Wimo Labs LLC, Chicago, IL (US)

(72) Inventor: Scott H. Wilson, Chicago, IL (US)

(73) Assignee: WIMO LABS LLC, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/635,562

(22) Filed: Mar. 2, 2015

(65) Prior Publication Data

US 2015/0164189 A1 Jun. 18, 2015

Related U.S. Application Data

(63) Continuation-in-part of application No. 13/344,375, filed on Jan. 5, 2012, now Pat. No. 8,967,437.

(60) Provisional application No. 61/429,917, filed on Jan. 5, 2011.

(51) Int. Cl.
*A44C 5/14* (2006.01)
*A44C 5/00* (2006.01)
(Continued)

(52) U.S. Cl.
CPC ... *A44C 5/14* (2013.01); *A45F 5/00* (2013.01); *G04B 37/1486* (2013.01); *A45F 2005/008* (2013.01)

(58) Field of Classification Search
CPC ..... A44C 5/00; A45F 2005/008
USPC ..... 224/165, 152, 219, 221, 222, 170, 180, 224/164, 168, 177
See application file for complete search history.

(56) References Cited

U.S. PATENT DOCUMENTS 2,032,696 A * 3/1936 Goldblatt ..... 368/174
2,136,625 A 3/1937 Lasko
2,188,471 A 10/1937 Bridler
(Continued)

FOREIGN PATENT DOCUMENTS

JP 2009268041 A 11/2009
KR 200202216 Y1 11/2000
KR 10-0879543 B1 1/2009

OTHER PUBLICATIONS

International Search Report and Written Opinion for PCT/US2012/020343 dated Aug. 30, 2012 (9 pp.).

*Primary Examiner* — Justin Larson
*Assistant Examiner* — Lester L Vanterpool
(74) *Attorney, Agent, or Firm* — Neal, Gerber & Eisenberg LLP

(57) ABSTRACT

A wearable electronic device holder having a retention member for retaining an electronic device, such as a smartwatch or an MP3 player, and a wrist strap attached to the retention member is disclosed. The retention member includes a protective frame comprising one or more covers or openings for receiving and allowing interaction with one or more buttons, knobs, and/or ports of the electronic device. At least one of the covers is configured to enable the dual-action functionality of a knob of the electronic device. The protective frame may also include an opening adapted to receive sound-permeable, waterproof inserts for an audio port of the electronic device. The protective frame further includes fastening holes for attachment to the wrist strap. The protective frame may be a two-piece frame that partially encloses the electronic device.

20 Claims, 17 Drawing Sheets

(51) Int. Cl.
*A45F 5/00* (2006.01)
*G04B 37/14* (2006.01)

(56) References Cited

U.S. PATENT DOCUMENTS

| | | | | |
|---|---|---|---|---|
| 3,010,627 | A * | 11/1961 | Hoover | 224/219 |
| 4,106,677 | A * | 8/1978 | Helmso et al. | 224/219 |
| 4,135,805 | A | 1/1979 | Taylor et al. | |
| 4,136,805 | A * | 1/1979 | Storms | 224/219 |
| 4,266,400 | A | 5/1981 | Tabata | |
| 5,008,864 | A * | 4/1991 | Yoshitake | 368/10 |
| 5,274,613 | A | 12/1993 | Seager | |
| 6,158,884 | A * | 12/2000 | Lebby et al. | 368/282 |
| 6,360,928 | B1 | 3/2002 | Russo | |
| 6,459,890 | B1 | 10/2002 | Kim | |
| 6,549,791 | B1 | 4/2003 | Jeon et al. | |
| 6,726,070 | B2 * | 4/2004 | Lautner | 224/221 |
| 6,742,685 | B2 | 6/2004 | Williams | |
| 6,757,390 | B2 * | 6/2004 | Ito et al. | 379/433.1 |
| 6,880,737 | B2 | 4/2005 | Bauer | |
| 7,243,824 | B2 | 7/2007 | Tabata | |
| D548,457 | S | 8/2007 | Reinerio | |
| 7,296,752 | B2 | 11/2007 | Carnevali | |
| 7,334,711 | B1 | 2/2008 | Winters | |
| 7,424,110 | B1 | 9/2008 | Whiten, III | |
| 7,469,809 | B2 | 12/2008 | Rodarte et al. | |
| 7,529,155 | B2 | 5/2009 | Fasciano | |
| 7,764,488 | B2 | 7/2010 | Calvarese | |
| 8,140,131 | B1 | 3/2012 | Green | |
| 8,328,055 | B1 | 12/2012 | Snyder | |
| 8,345,412 | B2 * | 1/2013 | Maravilla et al. | 361/679.03 |
| 8,534,514 | B2 * | 9/2013 | Zhu et al. | 224/165 |
| 8,616,423 | B2 | 12/2013 | Wizikowski | |
| 8,662,362 | B1 | 3/2014 | Bastian et al. | |
| 2003/0213822 | A1 * | 11/2003 | Lautner | 224/221 |
| 2005/0145657 | A1 | 7/2005 | Norberg | |
| 2007/0215663 | A1 | 9/2007 | Chongson et al. | |
| 2008/0017678 | A1 | 1/2008 | Anderson et al. | |
| 2009/0039121 | A1 | 2/2009 | Paul | |
| 2009/0044825 | A1 | 2/2009 | Lawrence et al. | |
| 2009/0321483 | A1 | 12/2009 | Froloff | |
| 2010/0192356 | A1 | 8/2010 | Zadesky et al. | |
| 2010/0327030 | A1 | 12/2010 | Yang | |

* cited by examiner

ELECTRONIC DEVICE CASING

CROSS REFERENCE TO RELATED APPLICATIONS

This application is a continuation in part of U.S. application Ser. No. 13,344,375, now U.S. Pat. No. 8,967,437, filed on Jan. 5, 2012 and entitled "Electronic Device Holder," which claims priority to the Jan. 5, 2011 filing date of U.S. Provisional Application No. 61/429,917, entitled "Wristband," both of which are incorporated herein by reference in their entirety.

TECHNICAL FIELD OF THE INVENTION

The present device relates to a holder for an electronic device. Particularly, the device relates to a wristband and a housing for retaining the electronic device within a secure area.

BACKGROUND OF THE INVENTION

Wristwatches are becoming more and more scarce it seems, as people want more than time related features from their electronic devices. It isn't enough that a watch can tell time in different countries or languages. It isn't enough that a watch can act as an alarm, stop watch and timer, with the push of any number of different bezel-mounted buttons. With the advent of MP3 players, smart phones, smart pads and other wireless computing devices, the time for Dad's (or Grandpa's) multi-function wristwatch has passed.

People want multi-touch control. They want game, personal, and productivity applications at their fingertips. They want music with download capabilities. However, they also want elegance to go with all that functionality. The ability to remain feminine or masculine and stylish is a need that has gone unappreciated by those designers attempting to take advantage of the popularity of devices such as the Apple® iPod nano MP3 player. Belt clips, pocket clips and arm bands are neither elegant nor stylish, and are inconvenient to use because they require regular attachment and detachment.

Further, people want more from their electronic devices, such as MP3 players or smartwatches. With respect to MP3 players, it isn't enough to provide a housing with a clip for attaching to an article of clothing. The device must be capable of integration into a user's particular lifestyle, not just as a running/walking/exercise accessory. While smartwatches have started to gain popularity, existing designs are limited to manufacturer-provided watch straps that provide some variance in aesthetics but no additional functionality or device protection. For example, for people with an active lifestyle, there is a need for a smartwatch that can be used seamlessly between work, the gym, outdoors, on weekends, etc. Moreover, just as people protect their cell phones with cases, there is a need to develop case protection for smart watches. As the electronic device manufactures fail to fill this need, a holder for such devices becomes more imperative.

The present device solves these and other problems associated with prior art devices. The present device provides a beautifully aesthetic and completely functional means for carrying an MP3 player, such as the Apple® iPod nano, and/or a smartwatch, such as the Apple® Watch, while allowing the user to have ready access to all the features of the electronic device without the need for detaching and reattaching associated with most existing holders.

SUMMARY OF THE INVENTION

There is disclosed herein an improved holder or casing for carrying an electronic device, such as an MP3 player (e.g., the Apple® iPod nano) and/or a smartwatch (e.g., the Apple® Watch), which avoids many of the disadvantages of prior devices while affording additional structural and operating advantages.

Generally speaking, the holder comprises a retention member for retaining an electronic device having a multi-touch screen, and a strap or clip attached to the retention member to allow fastening to any number of articles, including a user's wrist. The retention of the electronic device within the retention member may be accomplished in a variety of ways.

In one embodiment, the holder is a wristband and the electronic device is secured by friction fitting the device into a recessed area of the retention member. Two somewhat flexible ridges engage the device along two opposing edges. The device may be inserted through a face opening on the retention member or, alternately, the device may slide into place through a side opening. An opening on a back surface of the retention member allows the player to be pushed from the recessed area, if desired.

In another embodiment, the holder is a wristband and the retention member is comprised of a two-piece frame which at least partially encloses the electronic device. The frame pieces affix to a wristband strap as they are secured to one another.

In still another embodiment, the holder is a lock with a two-piece retention member similar to that of the previously described embodiment. The clasp of the lock may include a carabineer clip to make frequent attachment and removal of the holder easier and quicker.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
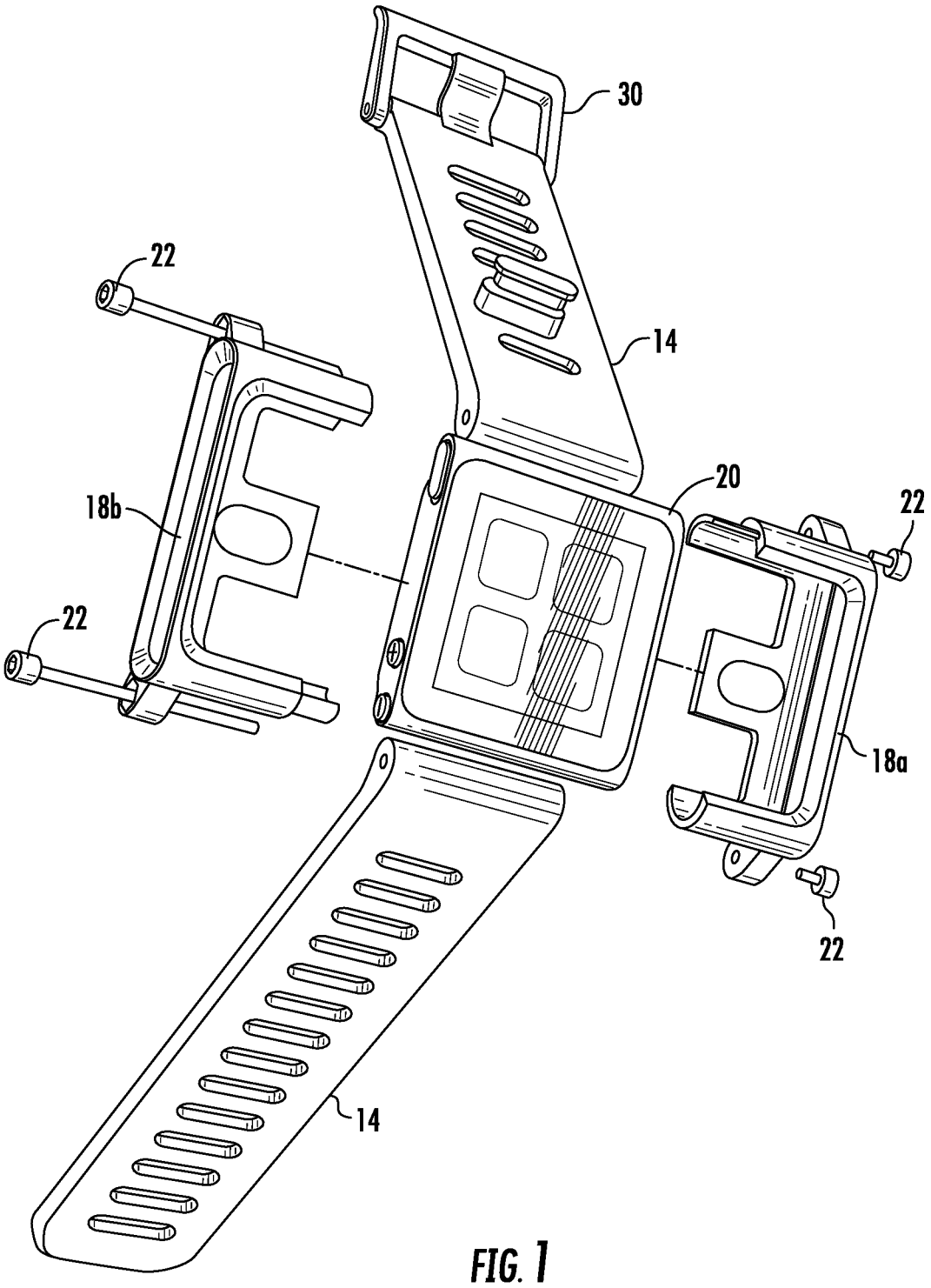
FIG. 1 is a front exploded view of an embodiment of the present device illustrating the capture and retention of an electronic device.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

Referring to FIGS. 1-7, there is illustrated embodiments of a wristband, generally designated by the numeral 10. The wristband 10 has a retention member 12 and a strap 14 which allows attachment of the entire device to, preferably, a user's wrist. The retention member 12 retains an electronic device 20, such as an MP3 player (e.g., an Apple® iPod nano (6th generation) as shown), or a smartwatch (e.g., an Apple® Watch), which then allows access to the functionality of the device as, for example, a wristwatch, a radio, a game console or the like. While the Apple® iPod nano is the only illustrated and the preferred electronic device for the disclosed embodiments, the wristband 10 is not limited to use with this device. It is anticipated that many other electronic devices may be readily adapted for mounting within the disclosed and claimed wristband with only slight modifications necessary.

For example, mobile phones, communication devices, calculators, heart/health monitors, GPS devices, analog/digital watches and countless other electronic gadgets may be configured to be worn within wristband 10. Only the retention member 12 need be adapted to the shape and controls of such gadgets. The retention member 12, in different embodiments, may provide one of either a quick and temporary retention of the device 20 or a more permanent retention, as desired by the user.

Figure 2:
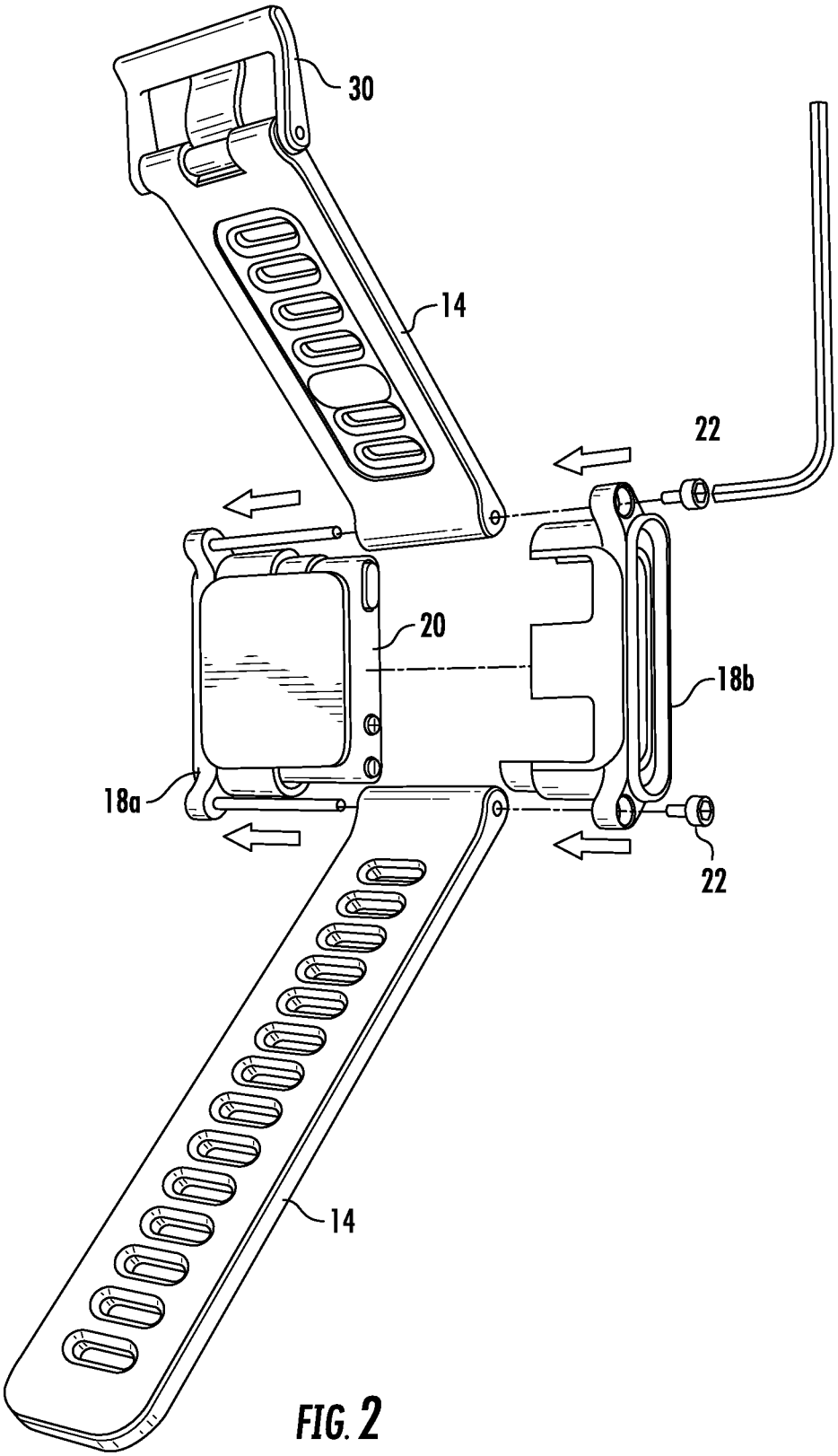
FIG. 2 is a rear exploded view of the embodiment of the present device shown in FIG. 1.
Figure 5:
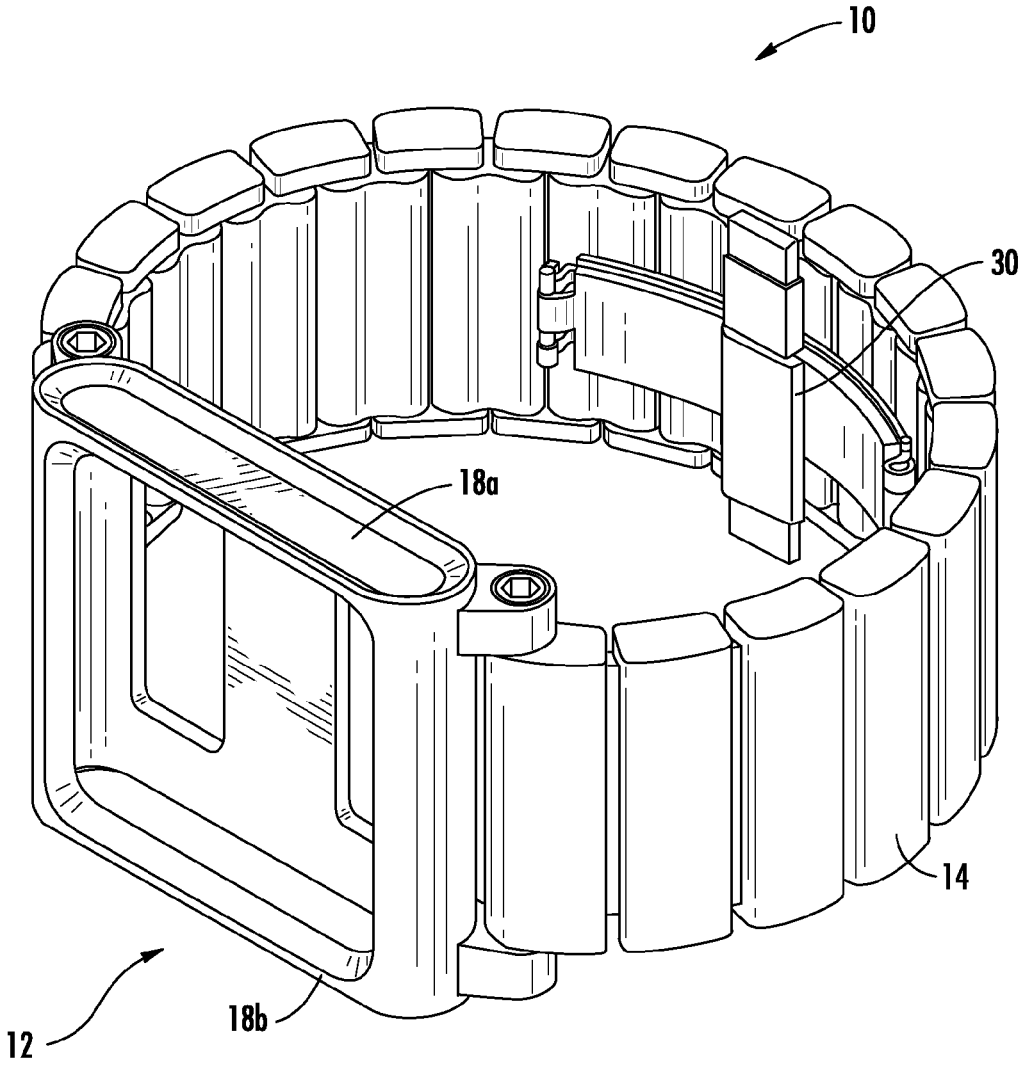
FIG. 5 is a perspective view of an embodiment similar to that of FIG. 3, except it includes a metal-link wristband.
Figure 6:
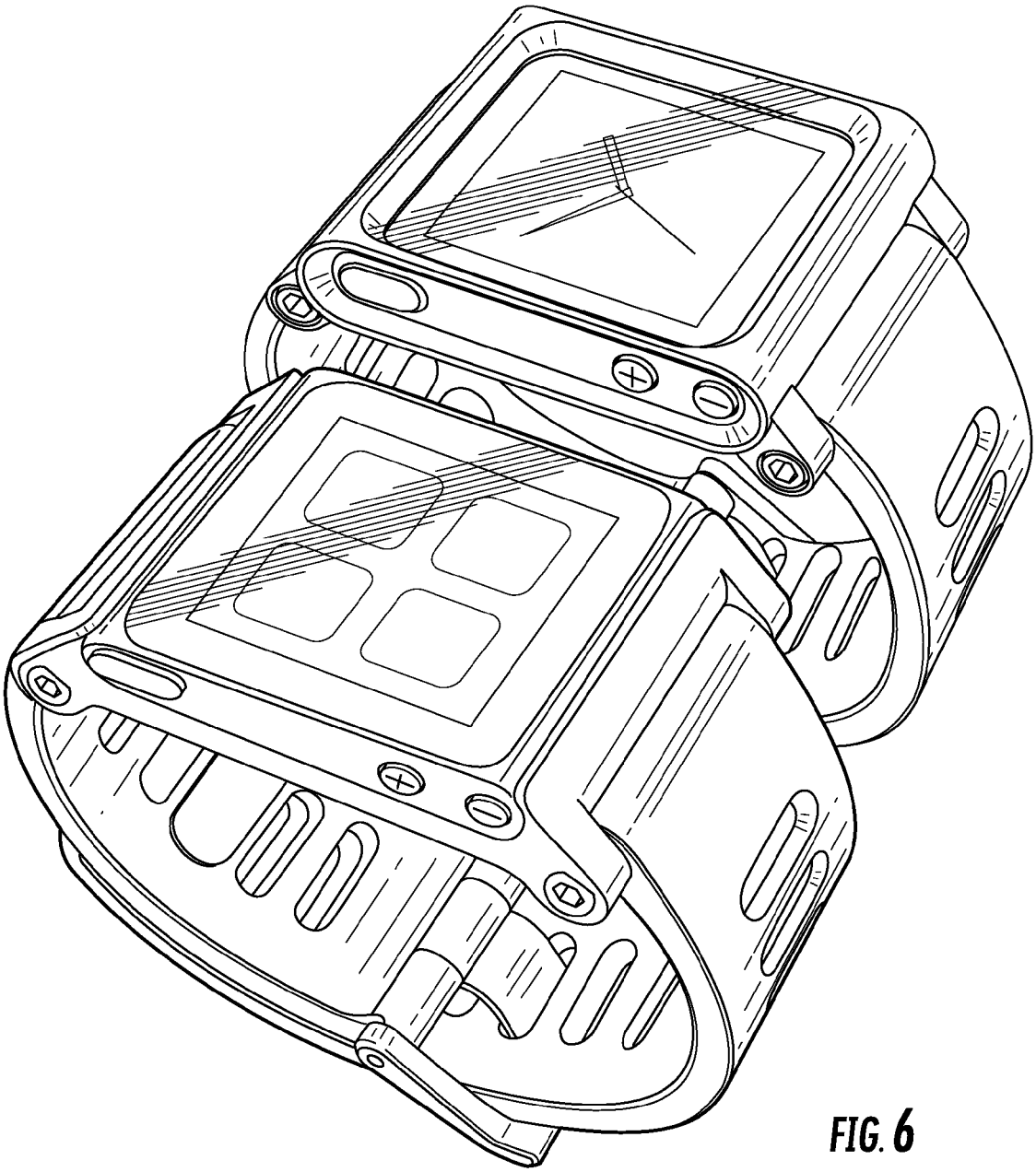
FIG. 6 is a perspective view of the embodiments of FIGS. 1 and 3 side-by-side.
Figure 7:
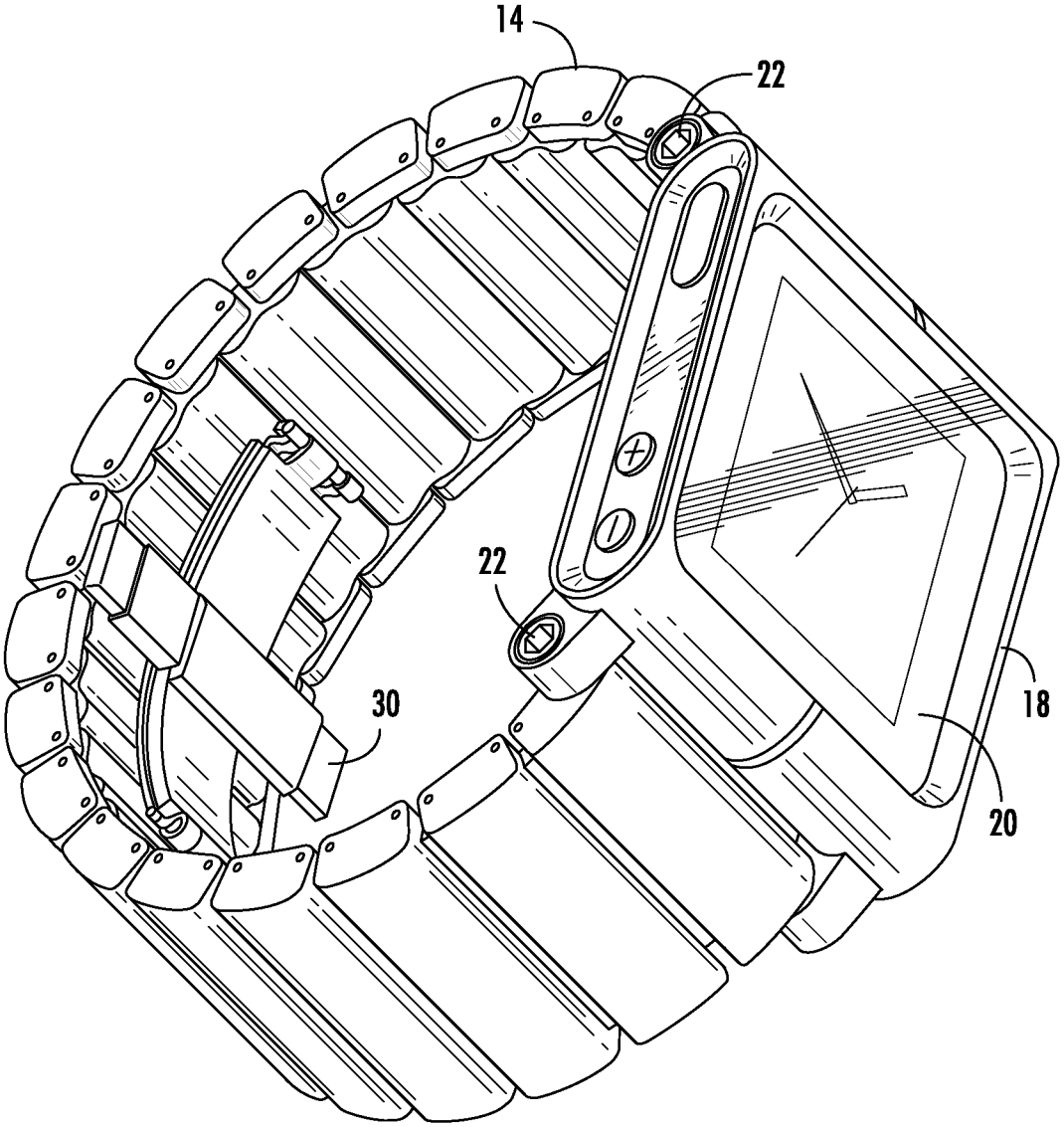
FIG. 7 is a perspective view of the embodiment of FIG. 5, including a seated electronic device.

In the embodiments of FIGS. 1, 2 and 5, the retention member 12 is preferably comprised of a two-piece frame 18 (also referred to herein as 18*a* and 18*b*). Of course, while frames of more complex configurations may be used, the two-piece frame 18 illustrated provides a secure retention of the electronic device 20 with minimal obscuring of the user screen and button controls. The illustrated two-piece frame 18 is preferably forged from aerospace grade aluminum which is machined to a final form on a CNC machine. Of course, other materials and methods may provide suitable results for some applications. The preferred machined frame members have appropriate openings to provide access to both the screen, for viewing and touch-screen interface, and button controls. However, the aluminum components also encase the device 20 sufficiently to provide protection of the same screen and button controls, and protection against accidental detachment of the electronic device 20 as well.

The two frame members 18*a* and 18*b* can be connected to one another after being placed about the electronic device 20 by two pairs of suitable fastening pins 22, as shown. The fastening pins 22 not only connect the two frame members 18*a* and 18*b* together, but also pass through the strap ends to attach these to the retention member 12 as well. A unique aspect of the two-piece frame 18, as discernible in FIGS. 1 and 2, is that the two halves are identical. That is, the right half 18*a* is the same as the left half 18*b*, only rotated 180°. By using two identical pieces, much time and cost is saved in both manufacture and assembly of the retention member 12 in this embodiment. Further, in the event of loss or damage to one side, replacement can be made without having to "orphan" a mating side and without having to replace an undamaged or remaining side. The resulting retention member 12 is symmetrical top-to-bottom, as well as side-to-side.

Figure 3:
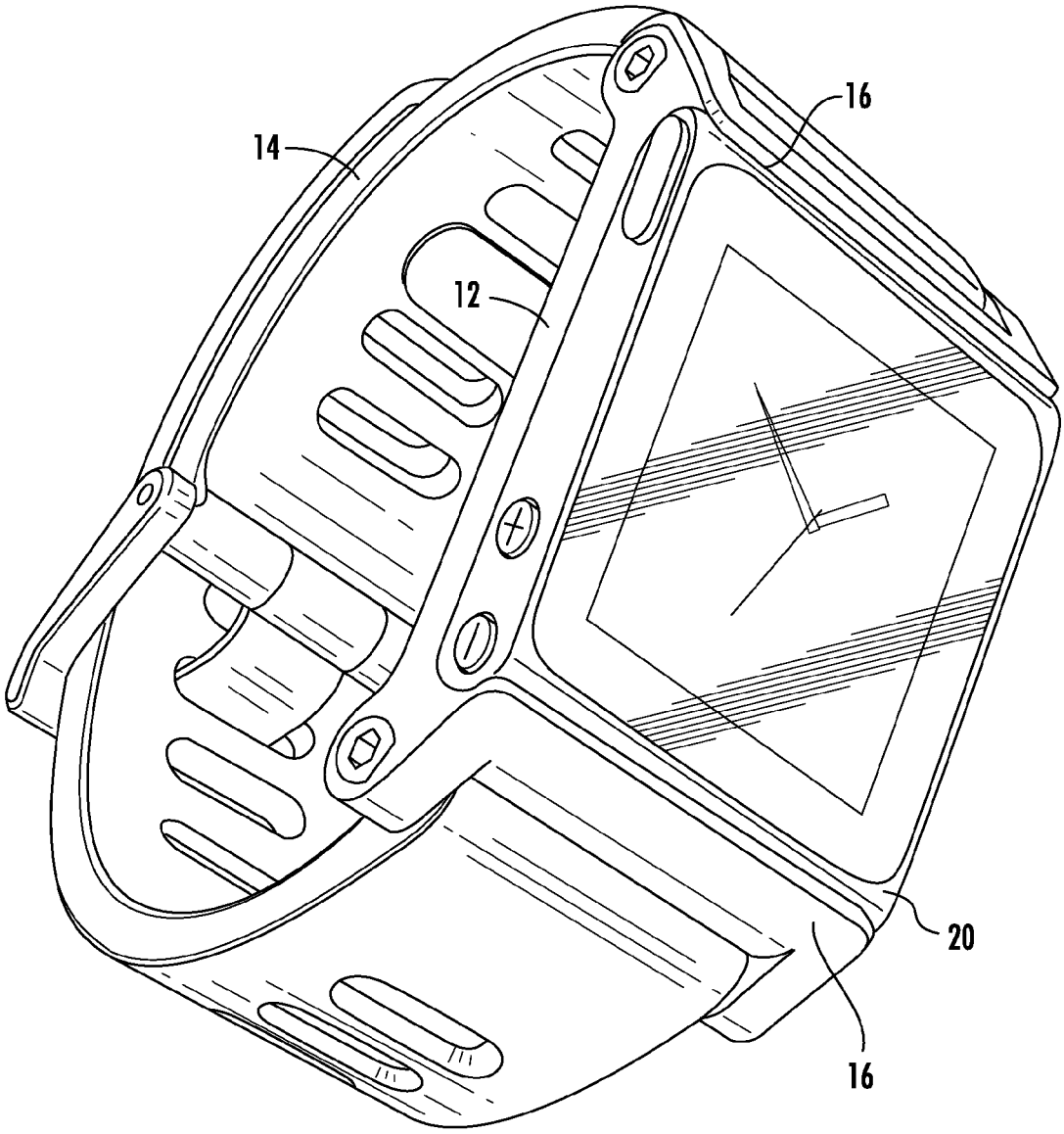
FIG. 3 is a front perspective of another embodiment of the present device illustrating the insertion of an electronic device.
Figure 4:
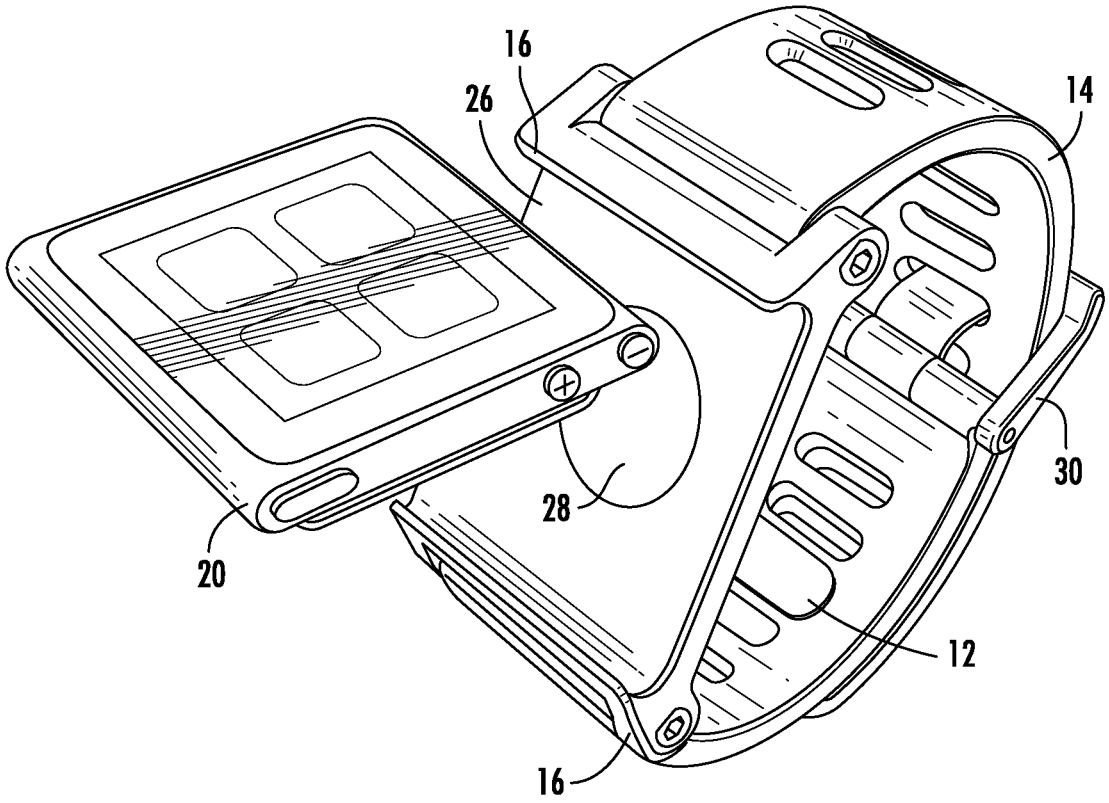
FIG. 4 is a front perspective of the embodiment of FIG. 3 showing the wristband with the electronic device detached.

In the embodiments of FIGS. 3 and 4, the retention member 12 is a simpler component, preferably made from a reinforced polycarbonate material. The retention member 12 is preferably comprised of a recessed area 26 defined by opposing surfaces of the retention member 12 and situated between two somewhat flexible ridges 16. The ridges 16 are contoured so as to engage the top and bottom sides of the electronic device 20, as shown.

Still referring to FIGS. 3 and 4, the device 20 may be inserted into the recessed area 26 of the retention member 12 in one of at least two ways. First, one of either the top or bottom edge of the device 20 is positioned in the recessed area 26 against one of the ridges 16. Then, the opposite end of the device 20 is pivoted down into the recessed area 26 until the edge snaps into place against the other ridge 16. Second, the device 20 can be slid from the side of the retention member 12 under the ridges 16 until it is properly seated in the recessed area 26. Again, the device 20 is frictionally held in place. An opening 28 in a back surface of the recessed area 26 of the retention member 12 allows the user to push the device 20 from the recessed area 26 when it is desired to remove the device 20. The opening 28 may also align with a product logo on the device 20, so as to clearly display the logo when the wristband 10 is not being worn. Otherwise, the two ridges 16 secure and retain the device 20 within the retention member 12.

The strap 14 in two of the disclosed embodiments (FIGS. 1 and 3) is preferably manufactured from a soft, silicone rubber material to provide the proper strength, comfort and look of a sporty or casual watchband. Again, other materials, such as polymers, leathers, metals, synthetic fabrics and the like, as well as alternate colors and styles may be used for different applications and designs. The strap 14 is also preferably a two-piece construction for adjustability, with a clasp 30 for connecting the two parts about a user's wrist. The clasp 30 is preferably made from forged, stainless steel.

The strap 14 of the embodiment of FIG. 5 is a more elegant and traditional watchband look. It is comprised of aluminum links connected together via a butterfly clasp 30. Again, the specific material (e.g., gold, silver, platinum, etc.) and finish of the metal-link band may be altered for different applications and designs. Certainly other styles for strap 14 not specifically mentioned herein are possible.

Referring to FIGS. 8-12, there is illustrated an embodiment of the electronic device holder as a lock and/or clip, which is generally designated by the numeral 110. The lock 110 has a retention member 112 and a generally U-shaped shank 114 which allows attachment of the entire device to, for example, a chain, a locker, a backpack or the like. Much like the watchband embodiments, the retention member 112 retains an electronic device 20, such as an MP3 player, and preferably an Apple® iPod nano (6th generation) as shown, which then allows access to the functionality of the device as, for example, a wristwatch, a radio, a game console or the like. While the Apple® iPod nano is the illustrated electronic device for the disclosed embodiment of FIGS. 8-12, the lock 110 is not limited to use with this device and can also be used with a smartwatch, such as the Apple® Watch. One of skill in the art would recognize that many other electronic devices may be readily adapted for mounting within the disclosed and claimed lock with only slight modifications necessary.

The retention member 112 of the lock 110 is preferably comprised of a two-piece frame 118. Of course, while frames of more complex configurations may be used, the two-piece frame 118 illustrated provides a secure retention of the electronic device 20 with minimal obscuring of the user screen and button controls. The illustrated two-piece frame 118 is preferably forged from aerospace grade aluminum which is machined to a final form on a CNC machine. Of course, other materials and methods may provide suitable results for some applications. The preferred machined frame members have appropriate openings to provide access to both the screen, for viewing and touch-screen interface, and button controls. However, the aluminum components also encase the device 20 sufficiently to provide protection of the same screen and button controls, and protection against accidental detachment of the electronic device 20 as well. The two frame members 118*a*, 118*b* can be connected to one another after being placed about the electronic device 20 by two suitable fastening pins 122, as shown.

The U-shaped shank 114, also preferably forged from aerospace grade aluminum, includes a carabineer clip 115 at one end. The two ends of the shank 114 have threaded openings which allow the pins 122 to secure each end of the shank to the retention member 112. However, the design, shape and material of the shank 114 may be changed to suit specific applications.

Figure 8:
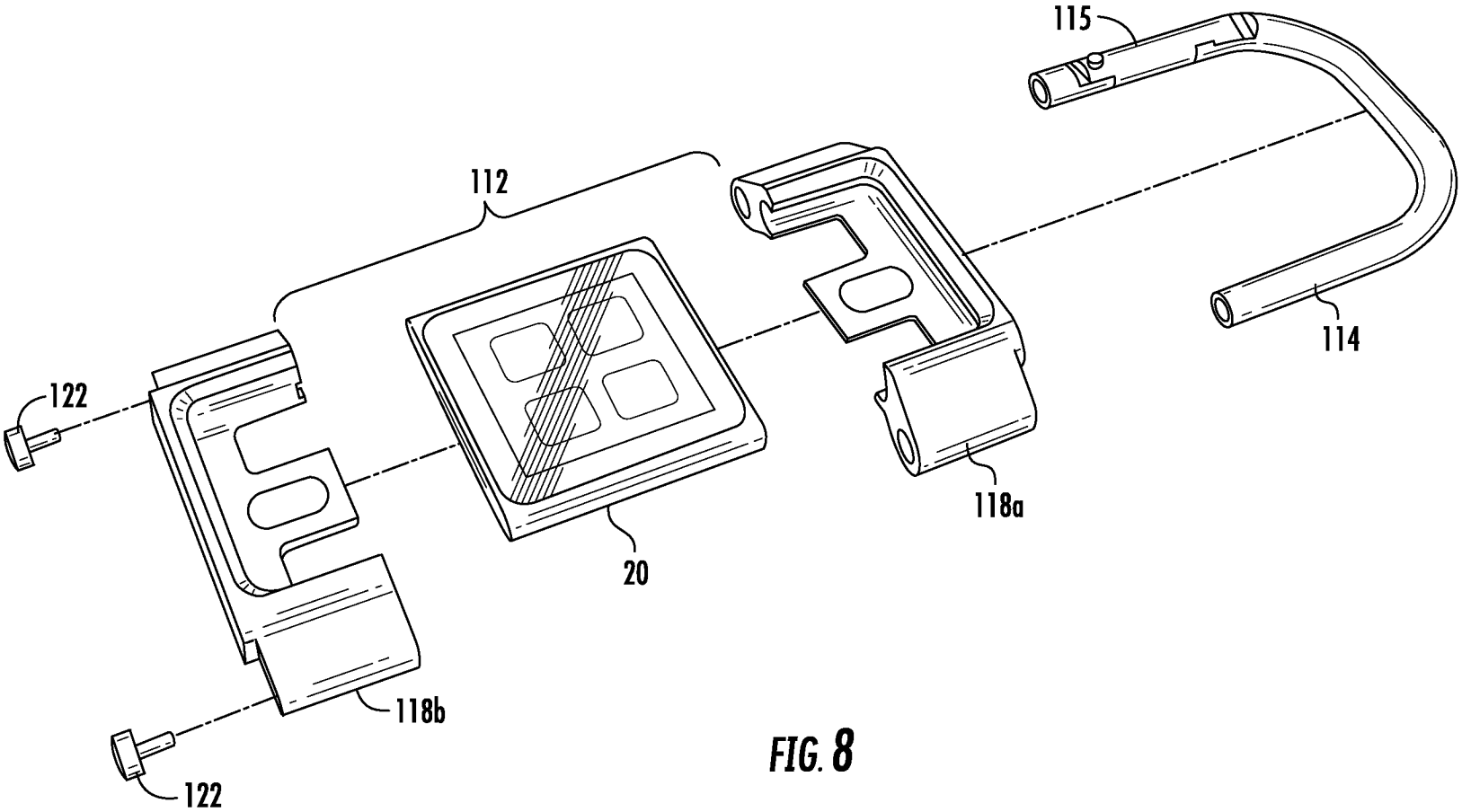
FIGS. 8-12 are various views of a third embodiment of an electronic device holder.
Figure 9:
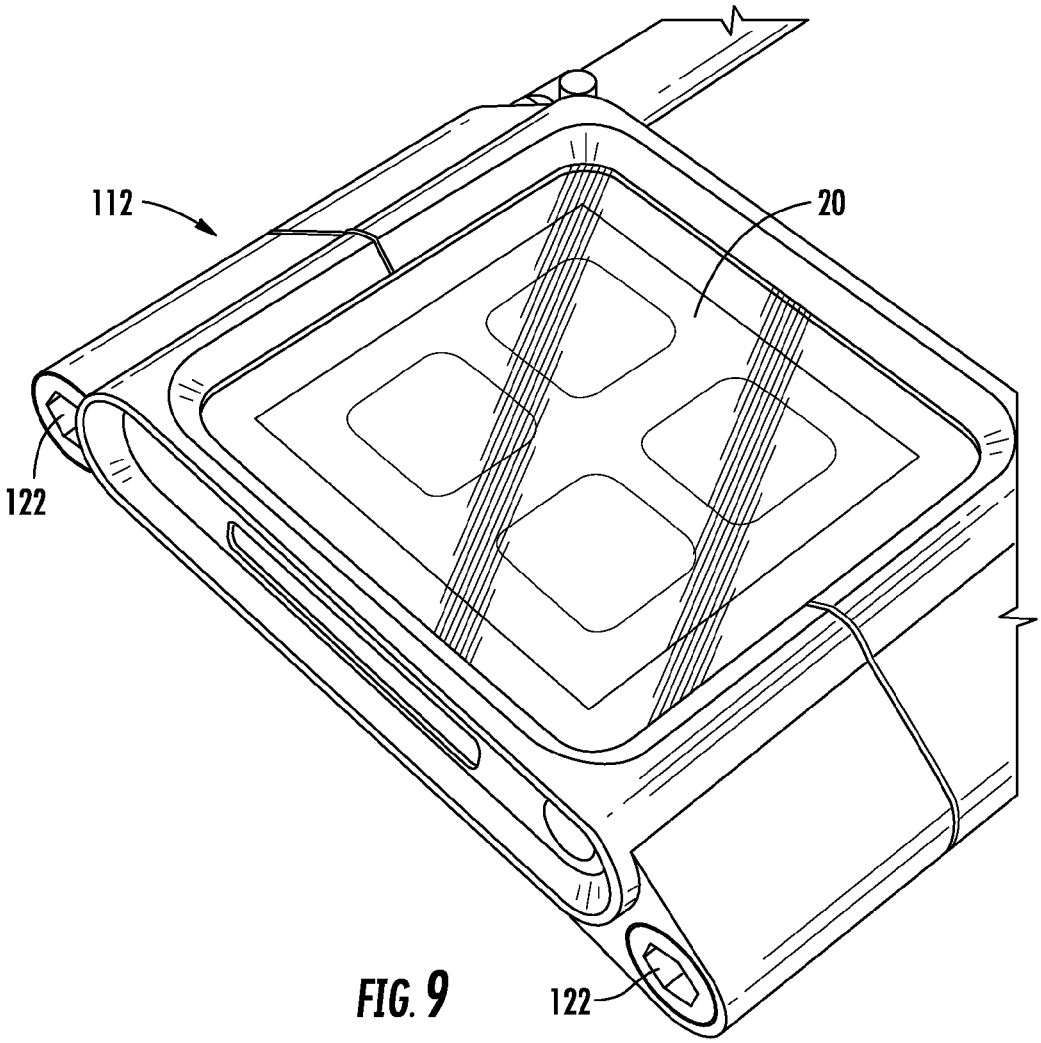
Figure 10:
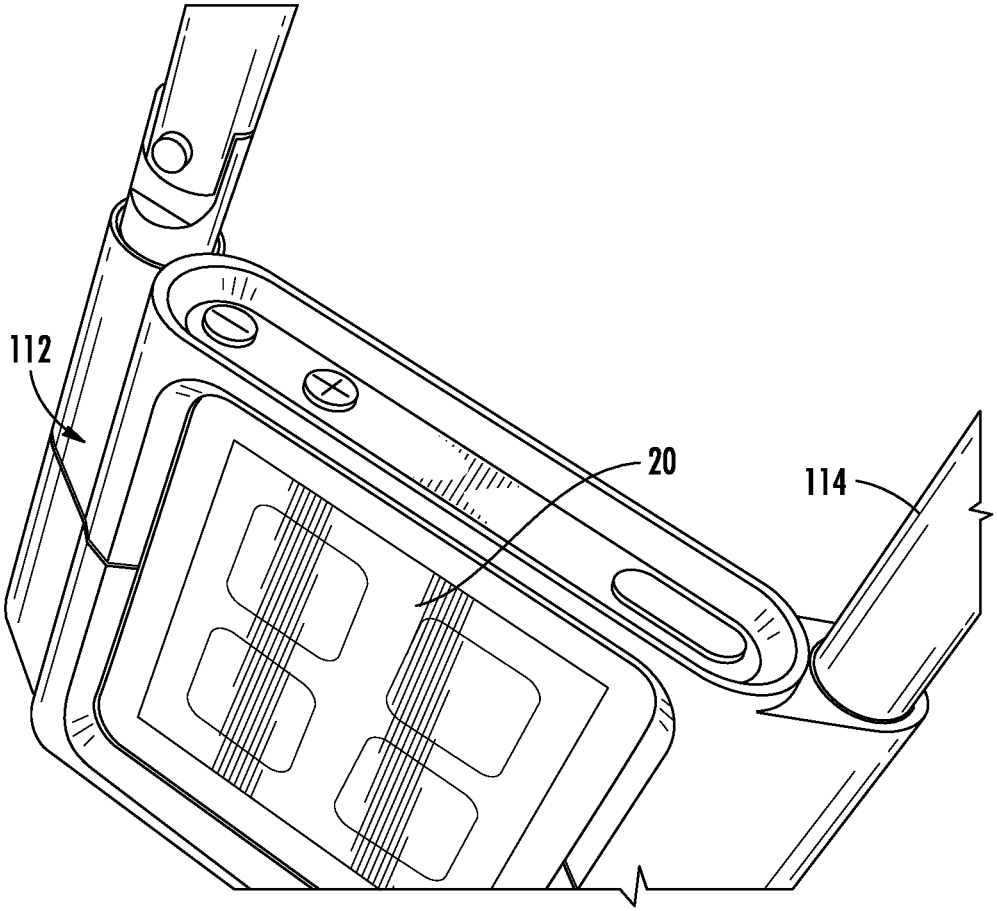
Figure 11:
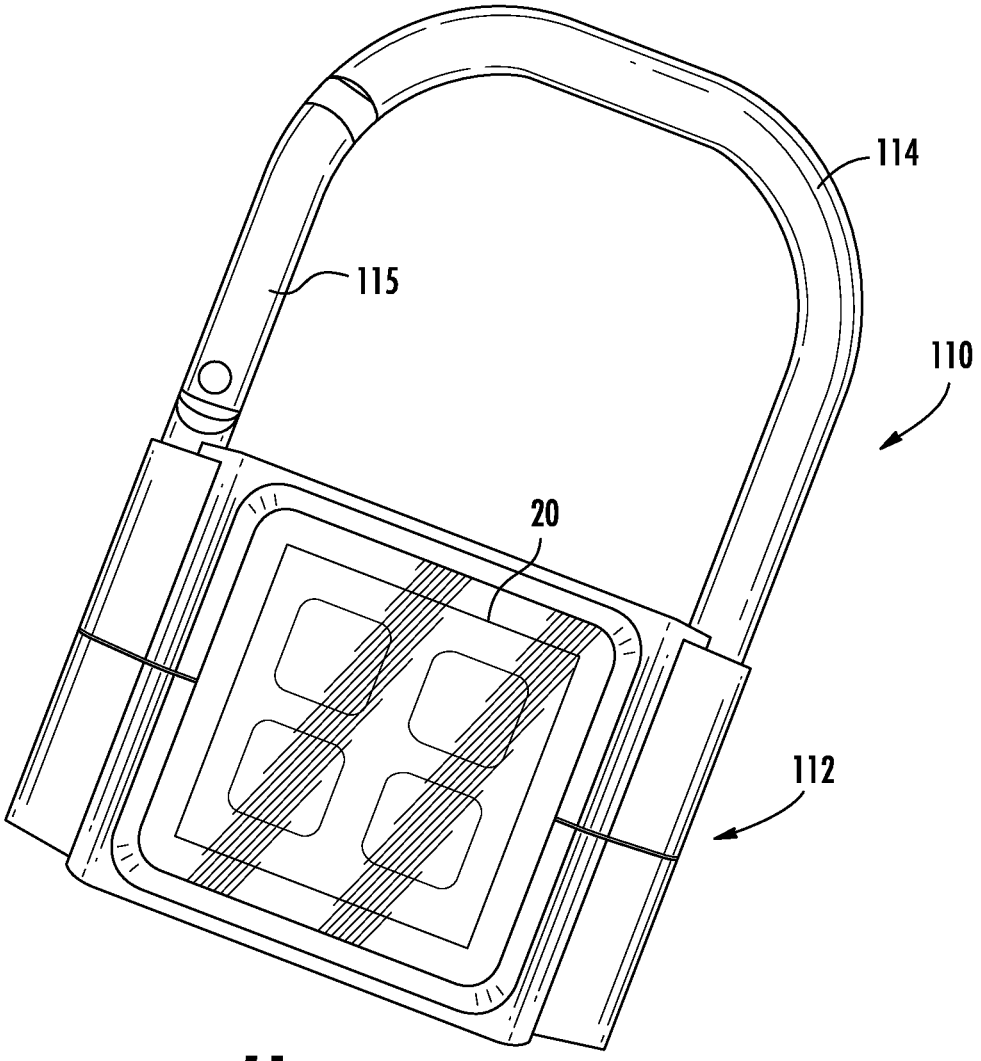
Figure 12:
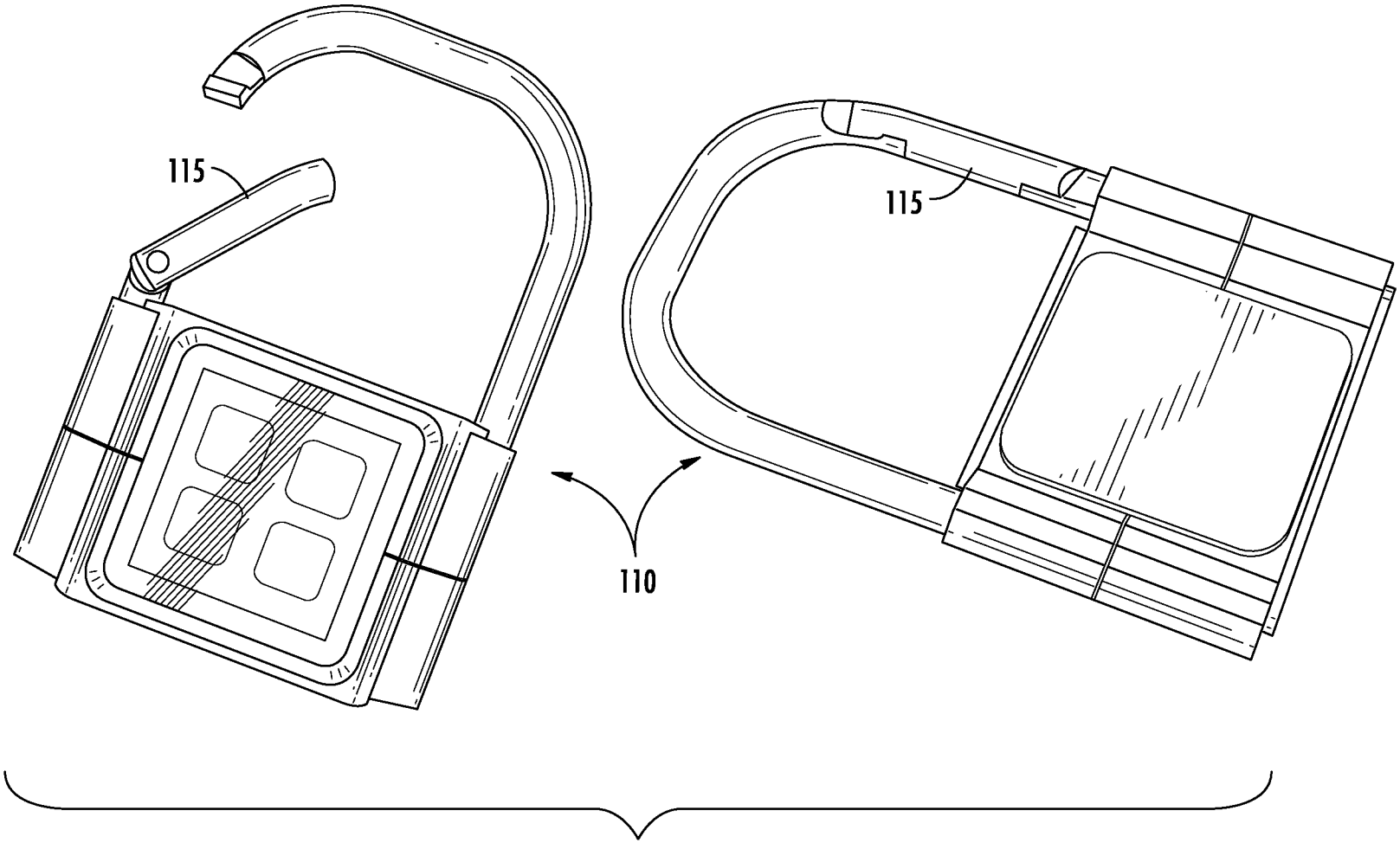

A unique aspect of the two-piece frame 118, as discernible in FIG. 8, is that the two halves are identical. That is, the top half 118*a* is the same as the bottom half 118*b*, only rotated 180°. By using two identical pieces, much time and cost is saved in both manufacture and assembly of the retention member 112 in this embodiment. Further, in the event of loss or damage to one side, replacement can be made without having to "orphan" a mating side and without having to replace an undamaged or remaining side. The resulting retention member 112 is symmetrical top-to-bottom, as well as side-to-side.

Referring to FIGS. 13-17, illustrated are embodiments of wearable electronic device casing 210 configured as a wristband. The casing 210 includes a retention member or 212, which retains an electronic device 20, such as a smartwatch (e.g., an Apple® Watch, as shown) or an MP3 player (e.g., an Apple® iPod nano (6th generation)). As explained below, retention member 212 is designed so as to provide a waterproof encasement for electronic device 20. Specifically, while all functional controls of device 20 remain accessible when installed in retention member 212, the member 212 prevents ingress of water into any openings of device 20 under up to 5 atmospheres of pressure, depending on the embodiment. The wearable casing 210 further includes a wrist strap 214 which allows attachment of the electronic device 20 to, preferably, a user's wrist, and provides access to the functionality of the device 20 as, for example, a wristwatch, a radio, a game console or the like. In the case of a smartwatch, which typically includes an electronic device portion and a manufacturer-provided watchband (not shown), the electronic device portion 20 can be removed from the watchband before being placed into the retention member 212.

While the Apple® Watch is the only illustrated electronic device 20 for the disclosed embodiment of FIGS. 13-17, the wearable casing 210 is not limited to use with this device 20. It is anticipated that many other electronic devices may be readily adapted for mounting within the disclosed and claimed wristband with only slight modifications necessary. For example, mobile phones, communication devices, calculators, heart/health monitors, GPS devices, analog/digital watches and countless other electronic gadgets may be configured to be worn within wearable casing 210. Only the retention member 212 need be adapted to the shape and controls of such gadgets. The retention member 212, in different embodiments, may provide one of either a quick and temporary retention of the device 20 or a more permanent retention, as desired by the user.

Figure 13:
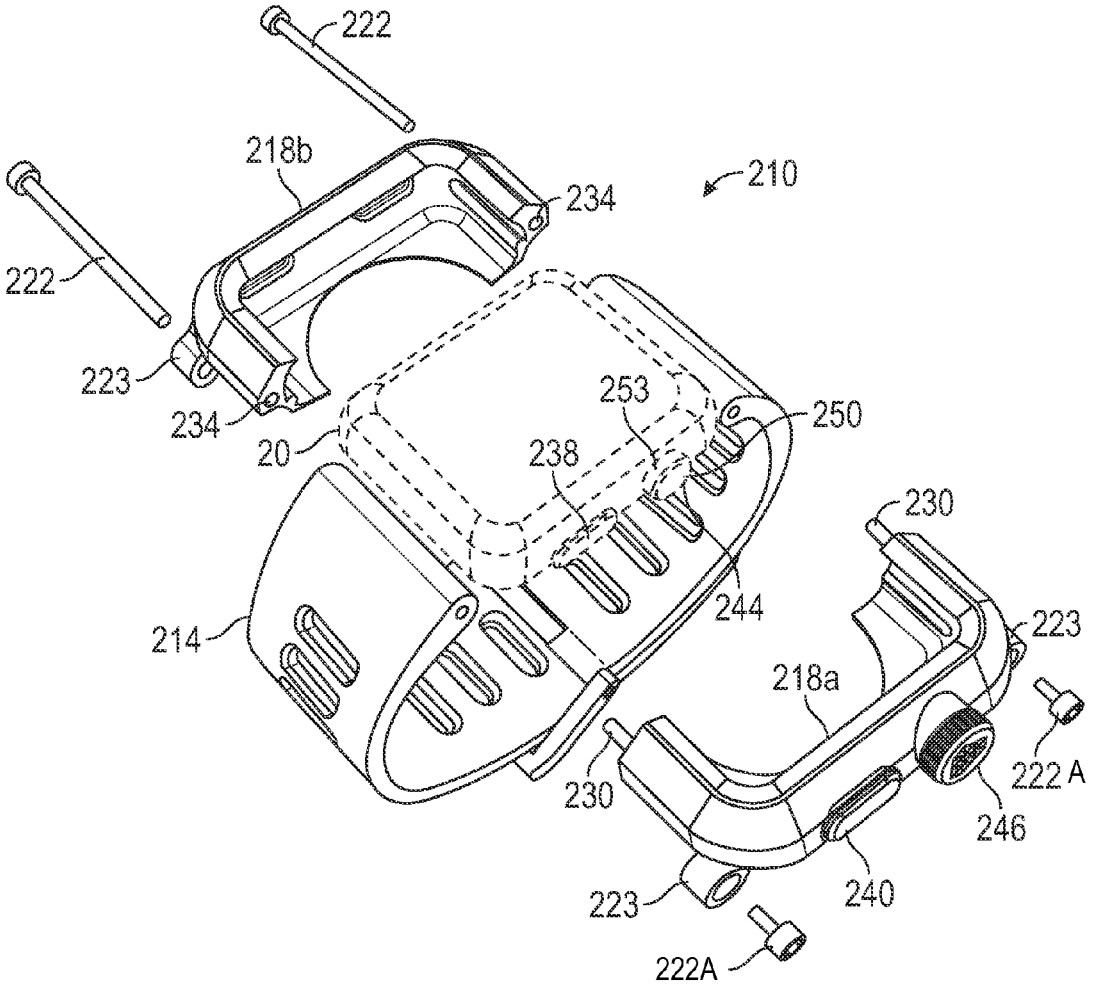
FIG. 13 is a front exploded view of an embodiment of the electronic device holder illustrating the capture and retention of an electronic device.
Figure 14:
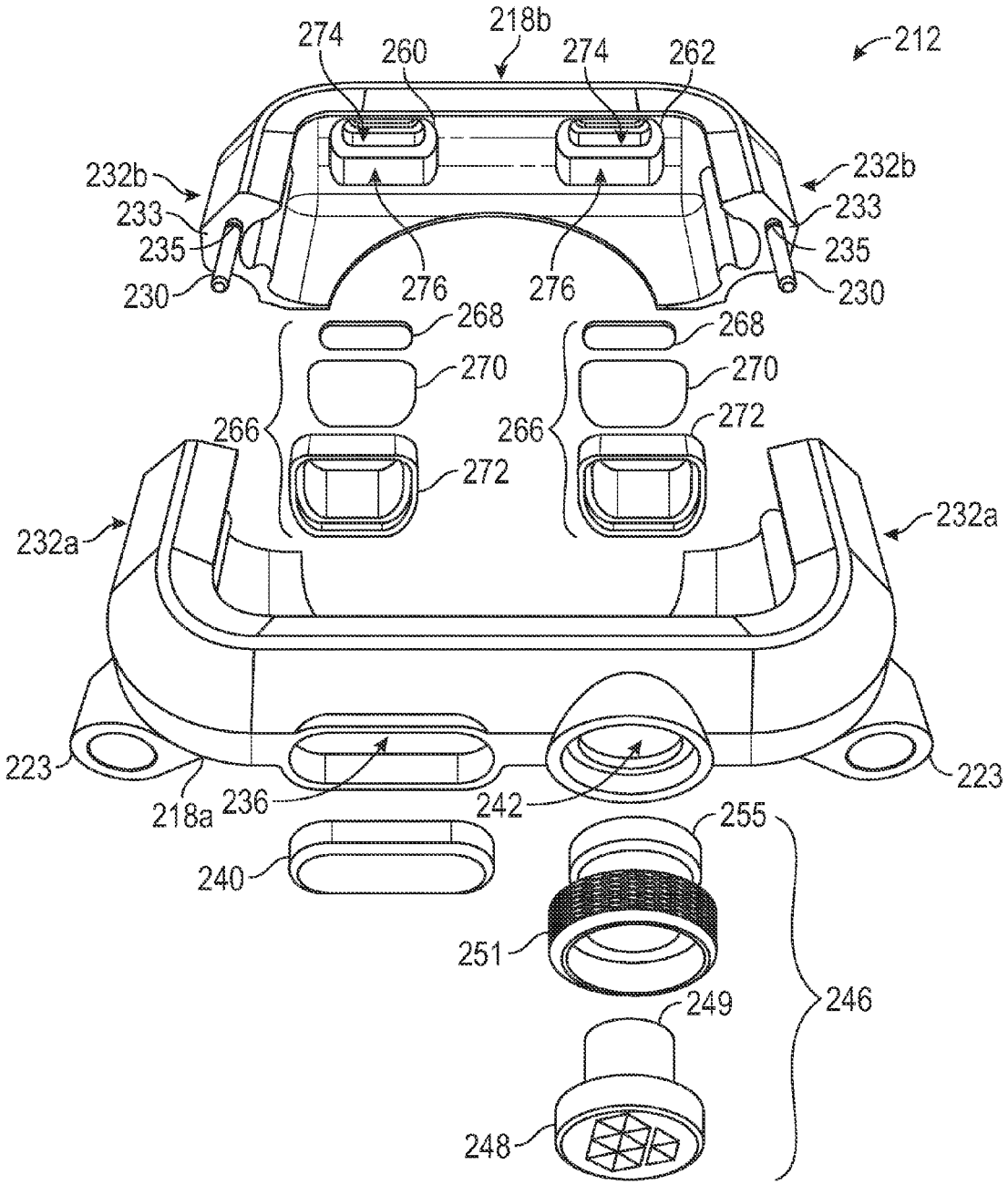
FIG. 14 is a side exploded view of the embodiment of FIG. 13 showing the wristband and electronic device detached.
Figure 15:
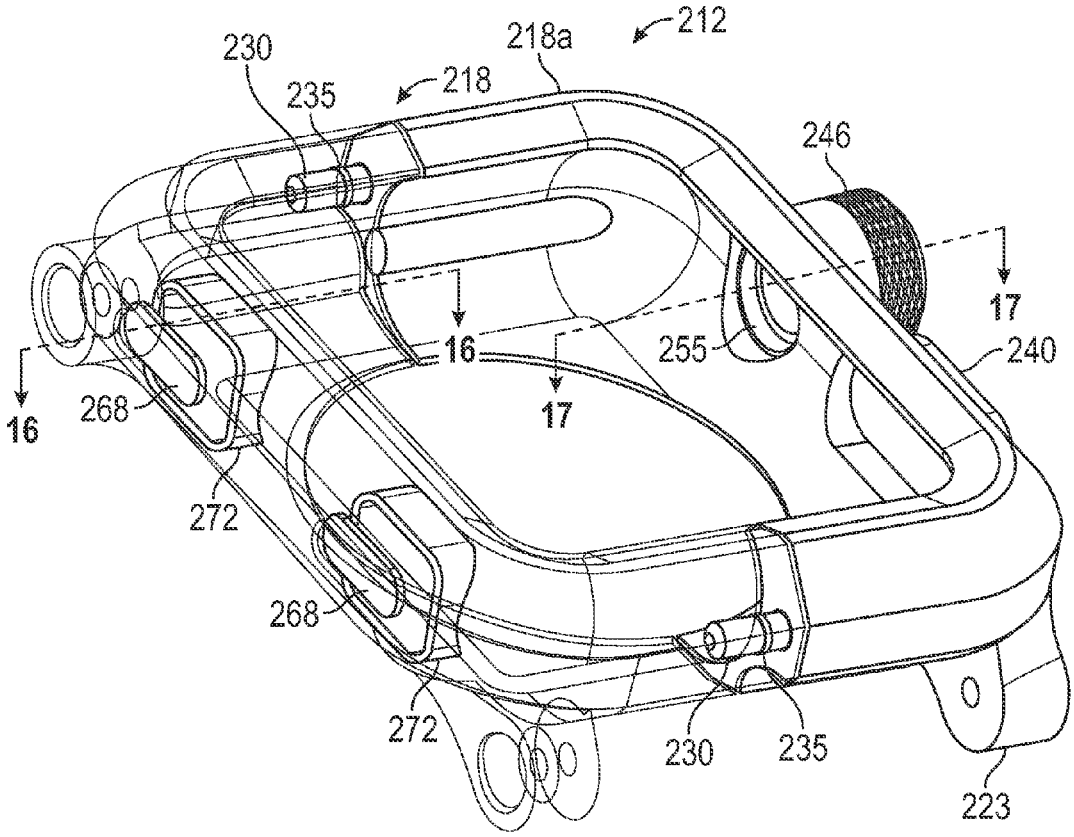
FIG. 15 is a front perspective view of the embodiment of FIG. 14 showing the holder in an assembled state with one half of the holder in phantom.

As shown in FIGS. 13-15, the retention member 212 is preferably comprised of a two-piece frame 218. Of course, while frames of more complex configurations may be used, the illustrated two-piece frame 218 provides a secure retention of the electronic device 20 with minimal obscuring of the user screen and/or button controls. The illustrated two-piece frame 218 is preferably forged from aerospace grade aluminum which is machined to a final form on a CNC machine. Of course, other materials and methods may provide suitable results for some applications. The preferred machined frame members have appropriate openings to provide access to both the screen, for viewing and touch-screen interface, and button controls. However, the aluminum components also encase the device 20 sufficiently to provide protection of the same screen and button controls, and protection against accidental detachment of the electronic device 20 as well.

The frame 218 comprises two frame members 218*a* and 218*b* that can be connected to one another by two pairs of suitable fastening pins 222 inserted through corresponding retaining extensions 223 located at the four corners of the retention member 212, as shown, for example, in FIG. 13. Each retaining extension has a through hole for receiving one of the fastening pins. Each fastening pin has a male and female component, such that the male component feeds through the through holes of the retaining extensions (one of each frame member) and joins to the female component. The fastening pins 222 not only connect the two frame members 218*a* and 218*b* together, but also pass through apertures at the ends of the strap 214 to attach the strap 214 to the retention member 212. The two frame members 218*a* and 218*b* can also be coupled together by a pair of suitable alignment pins 230, as described below.

As shown in FIG. 14, each frame member 218*a*, 218*b* includes a pair (top and bottom) of legs 232*a*, 232*b* that meet at interfacing surfaces 233 when the frame 218 is assembled, and each of the surfaces 233 can include a pin hole 234 for receiving one end of the corresponding alignment pins 230. The alignment pins 230 can be fastened to the holes 234 in either of the frame members 218*a* and 218*b* using a friction fit or other suitable fastening means. For example, FIG. 13 shows the alignment pins 230 coupled to the frame member 218*a*, ready for insertion into the pin holes 234 in the frame member 218*b*, while FIG. 14 shows the alignment pins 230 coupled to the frame 218*b* and ready for connection to the frame member 218*a*. As shown in FIG. 15, each of the alignment pins 230 can include a mechanical gasket 235, such as an o-ring, to seal any gaps at the pin holes 234 between the interfacing surfaces 233, from water-seepage and other damaging environmental elements. The alignment pins 230 can be made of a suitable metal or sturdy plastic, preferably stainless steel, and the gaskets 235 can be made of an elastomer, preferably rubber.

The strap 214 is preferably manufactured from a soft, silicone rubber material to provide the proper strength, comfort and look of a sporty or casual watchband. Certainly other styles for strap 214 not specifically mentioned herein are possible. Also, other materials, such as polymers, leathers, metals, synthetic fabrics and the like, as well as alternate colors and styles may be used for different applications and designs. The strap 214 is preferably a two-piece construction for adjustability, with a clasp (e.g., as shown in FIG. 1) for connecting the two parts about a user's wrist. The clasp is preferably made from forged, stainless steel, though other materials (e.g., gold, platinum, etc.) are also possible.

The retention member 212 can include a number of openings within the frame 218 to provide access to one or more buttons, dials, and/or ports of the electronic device 20. In embodiments, the frame member 218*a* can include a first opening 236 that receives a first button 238 of the electronic device 20 therein and an accompanying first cover 240 that provides access to the first button 238 when the electronic device 20 is placed within the wearable casing 210. An outer portion of the first cover 240 can have a shape and/or structure that is substantially similar to that of the first button 238, such as an ovoid structure as shown in FIG. 13. An inner portion of the first cover 240 can extend through the first opening 236 towards the electronic device 20, so that the first cover 240 is in contact with, or flush against, the first button 238 within the frame member 218*a*.

As also illustrated, the frame member 218*a* can include a second opening 242 that receives a second button 244 of the electronic device 20 therein and an accompanying second cover 246 that provides access to the second button 244 when the electronic device 20 is placed within the wearable casing 210. An outer portion of the second cover 246 can have a shape and/or structure that is substantially similar to that of the second button 244, such as a cylindrical or knob structure as shown in FIG. 13. An inner portion of the second cover 246 can extend through the second opening 242 towards the electronic device 20, so that the second cover 246 is in contact with, or flush against, the second button 244 within the frame member 218*a*.

In embodiments, the second cover 246 and/or the second opening 242 can include a plurality of components to enable access to various features or functionalities of the second button 244, including dual-action features. The second cover 246 can include a push button 248 that is configured for lateral movement relative to the second opening 242 and the second button 244. Pressing the push button 248 can cause a central surface 249 (also referred to herein as "push interface") of the push button 248 to press against a central or push portion 250 of the second button 244, thereby activating any push or press functionality of the second button 244.

The second cover 246 can also include a turn dial 251 that is configured for rotational movement relative to the second opening 242 and the second button 244. The turn dial 251 can include a dial surface 252 (also referred to herein as "turn interface") that surrounds an outer edge of, or creates a ring around, the central surface 249 of second button 244. When the electronic device 20 is placed within the frame 218, the dial surface 252 can be adjacent to and/or in contact with an outer or turn portion 253 of the second button 244. Rotating the turn dial 251 can cause the dial surface 252 to rotate or turn the outer portion 253 of the second button 244, thereby activating any dial-like functionality of the second button 244.

Figure 17:
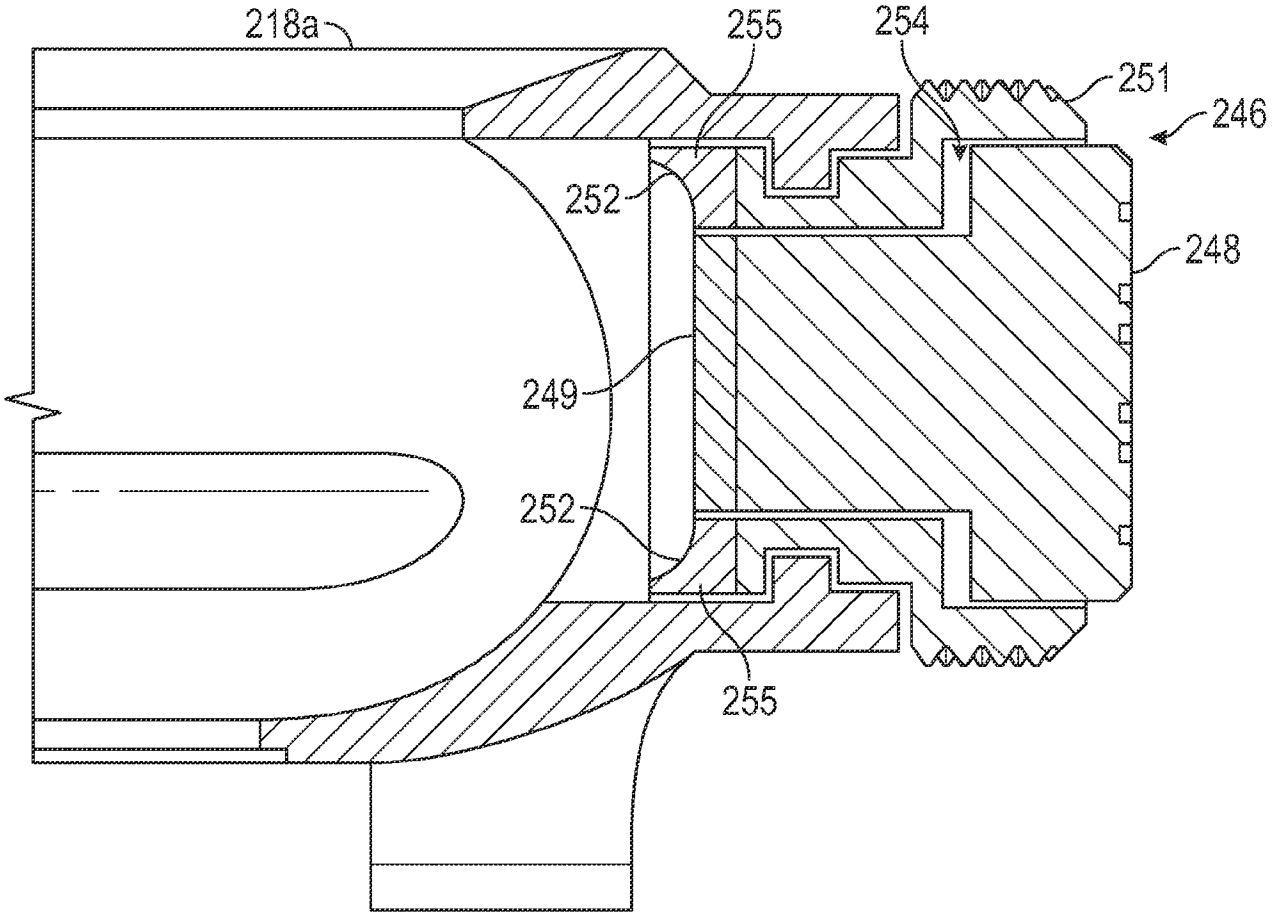

As shown in FIG. 17, the push button 248 can be positioned within a central cavity of the turn dial 251 such that a gap 254 is formed between the two and the push button 248 essentially floats within the turn dial 251, which serves as a cage to retain the push button. The gap 254 allows lateral movement of the push button 248 without touching or causing movement of the turn dial 251, and enables the turn dial 251 to rotate without touching or causing movement of the push button 248, thereby preserving any dual-action functionality of the second button 244.

In the illustrated embodiment, the turn dial 251 has a textured surface to enable slip-free gripping of the dial 251 by the user during rotation. In embodiments, the second button 244 can also have textured, slip-free gripping features on the outer portion 253 of the button 244, and the second cover 246 can be configured to grasp said textured portions of the second button 244. For example, as shown in FIG. 17, the second cover 246 can include a non-slip gasket 255 that is molded to fit over or around the second button 244 and create a friction fit therewith. The non-slip gasket 255 can be made of rubber or other suitable material that can grip, or stick to, the second button 244 to ensure that the second cover 246 stays secured to or pressed against the second button 244 during rotation of the turn dial 251. In some embodiments, the non-slip gasket 255 forms the dial surface 252 of the turn dial 251 and/or the central surface 249 of the push button 248. In some embodiments, the non-slip gasket 255 and/or the push button 248 and turn dial 251 can include a light adhesive coating to keep the second cover 246 secured to the second button 244, particularly during rotation of the turn dial 251 and the press and release movements of the push button 248. The rubber gasket 255 can also be configured to secure the second opening 242 and help prevent water-seepage and/or infiltration of other environmental elements.

As shown in FIG. 14, the retention member 212 can also include a third opening 260 and/or a fourth opening 262 for accommodating one or more ports (not shown) in the electronic device 20. The openings 260, 262 can be configured according to a shape, size, number, and placement of corresponding ports in the electronic device 20. In the illustrated embodiment, the openings 260 and 262 correspond to two audio ports (not shown) on a side of the electronic device 20 opposite the buttons 240 and 244, the audio ports including at least one of a speaker port or a microphone port. In other cases, the openings 260, 262 can correspond to a sensor port, a charging port, a data port, and/or any other component of the electronic device 20 that requires access thereto after placement within the retention member 212. Further, while the openings 260, 262 are substantially identical in the illustrated embodiment, in other embodiments each of the openings 260, 262 can have a different shape, size, placement, and/or function to accommodate the ports of the electronic device 20.

Figure 16:
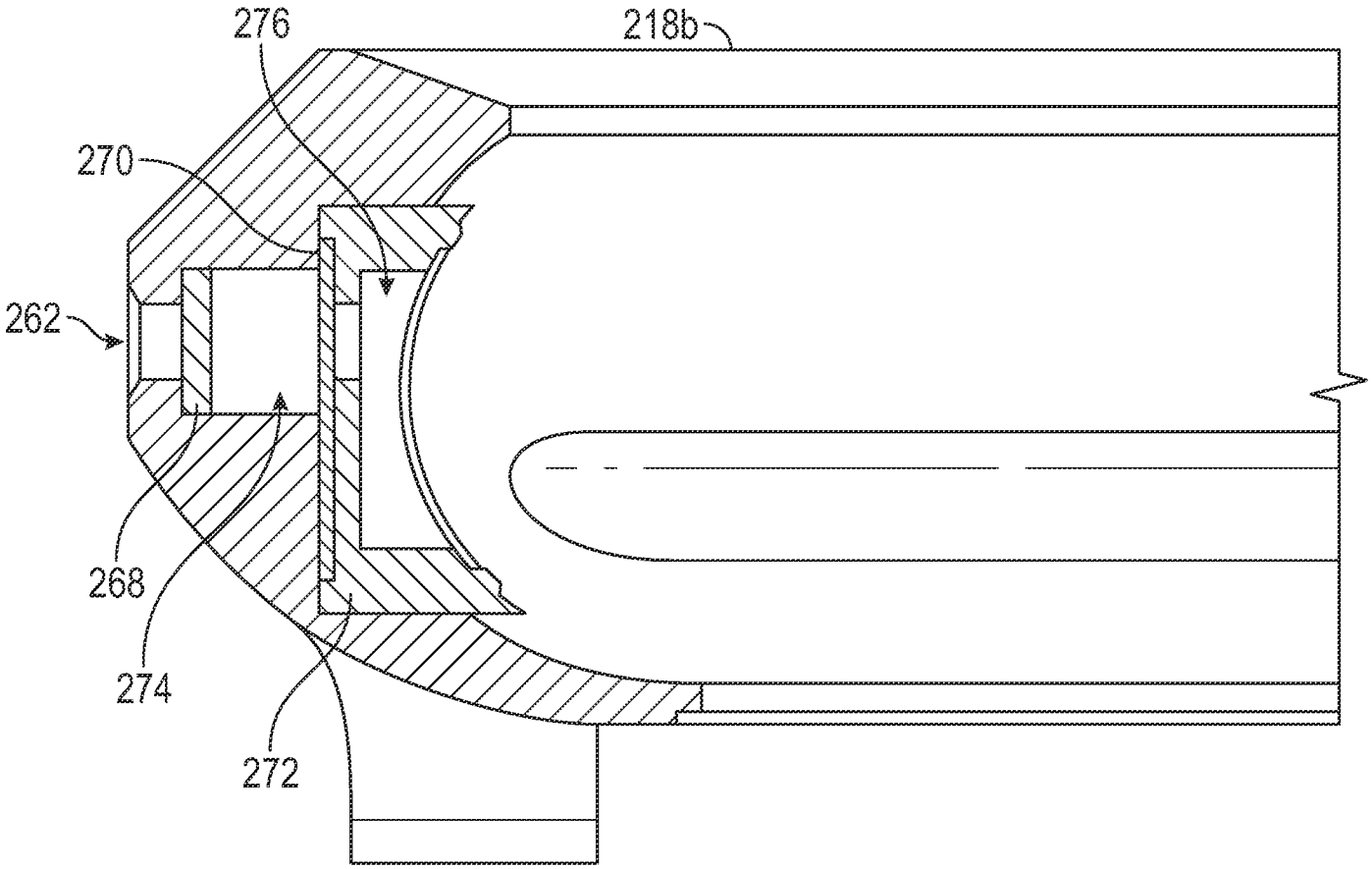
FIGS. 16 and 17 are partial cross-sectional views of the embodiment of FIG. 15.

As shown in FIGS. 14 and 16, each the openings 260, 262 can include a set of adjoining cavities that are stacked together to receive a series of inserts 266 for protecting the openings 260, 262 from water seepage and other environmental elements. For example, the inserts 266 can include a combination of sound permeable speaker covers and waterproof gaskets for sealing the speaker and/or microphone ports of the electronic device 20. The inserts 266 can be made of plastic, rubber, metal, and/or any other suitable material. In some cases, one or more of the inserts 266 can be laminated to create a waterproof seal.

As illustrated, each set of inserts 266 can include one or more of an external layer 268, a middle layer 270, or an internal layer 272. In embodiments, the external layer 268 can be a grated covering (e.g., speaker grill) or any other sound-permeable, water-impermeable piece that is configured for placement into a first cavity 274 of at least one of the openings 260, 262. As shown, the first cavity 274 provides access to an outside of the retention member 212 for audio transmission. The internal layer 272 can be a boot or plug-like gasket that fits or compresses into a second cavity 276 of at least one of the openings 260, 262 to create a waterproof seal. As shown, the second cavity 276 is sandwiched between the first cavity 274 and an internal space formed by the retention member 212 when assembled around the electronic device 20. In embodiments, the internal layer 272 can be adjacent to, or flush against, the electronic device 20 when placed into the wearable electronic device casing 210.

The middle layer 270 can be a substantially flat shield or film layer (preferably, sound permeable but not water permeable) that is optionally placed between the internal layer 272 and the external layer 268 for added protection and/or improved sound quality. For example, FIGS. 14 and 16 show the middle layer 270 in between the internal layer 272 and the external layer 268, while FIG. 15 shows no middle layer between the layers 268 and 272. In the illustrated embodiment, the middle layer 270 can be placed against or within a window of the internal layer 272 such that the middle layer 270 acts as a seal between the first cavity 274 and the second cavity 276. In some cases, the openings 260, 262 can further include a middle cavity (not shown) that is configured to receive the middle layer 270 between the first cavity 274 and the second cavity 276, before placement of the internal layer 272 into the second cavity 276.

In embodiments, the frame members 218*a* and 218*b* can be configured to cover, or couple to, any two opposing sides of the electronic device. In the illustrated embodiments, the frame members 218*a* and 218*b* are configured to fit over the opposing left and right sides of the electronic device 20 and join at a vertical axis running down the electronic device 20. In other embodiments (not shown), the frame members 218*a* and 218*b* can be configured to fit over the opposing top and bottom sides of the electronic device 20 and join at a horizontal axis running across the electronic device 20. In such embodiments, each frame member 218*a*, 218*b* can include a different combination of the openings and control covers disclosed herein for providing access to the buttons, dials, and/or ports of the electronic device 20. For example, the frame member 218*a* may be configured to couple to a top portion of the electronic device 20 and may include the second cover 246 and the second opening 242 on one leg and the opening 262 on the other leg. Likewise, the frame member 218*b* may be configured to couple to a bottom portion of the electronic device 20 and may include the first cover 240 and the first opening 236 on one leg and the opening 260 on the other leg.

Certainly other configurations for the frame 218 of the retention member 214 are also possible in accordance with the principles and teachings herein. For example, in some instances, all of the openings and casings of the frame 218 may be included in one large frame member 218*a* that covers at least three sides of the electronic device 20, and the frame member 218*b* can be configured to cover the fourth side of the electronic device 20. In such instances, the device 20 can be inserted into the frame 218 between the two legs of the frame member 218*a* and held in place by securing the frame member 218*b* to the frame member 218*a*.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

The invention claimed is:

1. A wearable casing for supporting an electronic device, comprising:

a first frame member comprising:

a sidewall extending between a top leg and a bottom leg, the top and bottom legs extending perpendicularly away from the sidewall;

a top retaining extension extending from one of the sidewall or the top leg; and a bottom retaining extension extending from one of the sidewall or the bottom leg;

a second frame member comprising:

a sidewall extending between a top leg and a bottom leg, the top and bottom legs extending perpendicularly away from the sidewall;

a top retaining extension extending from one of the sidewall or the top leg; and a bottom retaining extension extending from one of the sidewall or the bottom leg; and a strap having at least a first end and a second end;

wherein the first and second frame members are configured to slide together around the electronic device thereby bringing the top retaining extension of the first frame member closer to the top retaining extension of the second frame member so as to secure the first end of the strap and the bottom retaining extension of the first frame member closer to the bottom retaining extension of the second frame member so as to secure the second end of the strap.

2. The wearable casing of claim 1, wherein the strap is a wrist strap, such that the strap combines with the first and second frame members to form a circular band for securing the electronic device to a user's wrist.

3. The wearable casing of claim 1, wherein each retaining extension presents a through hole that is parallel with the top legs and the bottom legs when the first and second frame members slide together to form the housing.

4. The wearable casing of claim 3, wherein a male fastening pin component passes through the bottom retaining extension of the first frame member, through an aperture in the second end of the strap, through the bottom retaining extension of the second frame member and connects with a female fastening pin component to at least partially secure the strap to the housing.

5. The wearable casing of claim 1, wherein the second frame member comprises at least one alignment pin for alignment with and insertion into a corresponding pin hole formed in the first frame member.

6. The wearable casing of claim 1, wherein the first frame member further comprises:

an opening in the sidewall;

a sound-permeable, water-impermeable film layer covering over the opening from an inside of the sidewall; and a compressible boot surrounding a perimeter of the film layer and positioned to compress the film layer against the opening in the sidewall when the electronic device is installed in the housing.

7. The wearable casing of claim 1, wherein the second frame member further comprises a control cover having a push button component for translational input to the electronic device and a turn dial component for rotational input to the electronic device.

8. The wearable casing of claim 7, wherein the turn dial component further comprises a non-slip gasket that seats against a rotational control of the electronic device when the electronic device is inserted within the housing.

9. The wearable casing of claim 7, wherein the turn dial component forms a cage to retain the push button component.

10. The wearable casing of claim 9, wherein rotation of the turn dial component does not cause the push button component to rotate.

11. A casing for an electronic device comprising:

a first frame member comprising:

a sidewall extending between a top leg and a bottom leg, the top and bottom legs extending perpendicularly away from the sidewall;

a top retaining extension extending from one of the sidewall or the top leg; and a bottom retaining extension extending from one of the sidewall or the bottom leg;

a second frame member comprising:

a sidewall extending between a top leg and a bottom leg, the top and bottom legs extending perpendicularly away from the sidewall;

a top retaining extension extending from one of the sidewall or the top leg; and a bottom retaining extension extending from one of the sidewall or the bottom leg;

a top fastening pin extending through the top retaining extension of the first frame member and the top retaining extension of the second frame member; and a bottom fastening pin extending through the bottom retaining extension of the first frame member and the bottom retaining extension of the second frame member;

wherein the top and bottom fastening pins serve to join the first and second frame members together to form a housing around the electronic device.

12. The casing of claim 11, further comprising a strap that connects the top fastening pin to the bottom fastening pin.

13. The casing of claim 11, wherein each retaining extension presents a through hole that is parallel with the top legs and the bottom legs.

14. The casing of claim 12, wherein the bottom fastening pin comprises a male fastening pin component and a female fastening pin component, and wherein the male fastening pin component passes through the bottom retaining extension of the first frame member, through an aperture in the strap, through the bottom retaining extension of the second frame member and connects with the female fastening pin component to at least partially secure the strap to the housing.

15. The casing of claim 11, wherein the second frame member comprises at least one alignment pin for alignment with and insertion into a corresponding pin hole formed in the first frame member.

16. The casing of claim 11, wherein the first frame member further comprises:

an opening in the sidewall;

a sound-permeable, water-impermeable film layer covering over the opening from an inside of the sidewall; and a compressible boot surrounding a perimeter of the film layer and positioned to compress the film layer against the opening in the sidewall when the electronic device is installed in the housing.

17. The casing of claim 11, wherein the second frame member further comprises a control cover having a push button component for translational input to the electronic device and a turn dial component for rotational input to the electronic device.

18. The casing of claim 17, wherein the turn dial component further comprises a non-slip gasket that seats against a rotational control of the electronic device when the electronic device is inserted within the housing.

19. The casing of claim 17, wherein the turn dial component forms a cage to retain the push button component.

20. The casing of claim 19, wherein rotation of the turn dial component does not cause the push button component to rotate.

* * * * *